US007137267B2

(12) United States Patent
Murase et al.

(10) Patent No.: US 7,137,267 B2
(45) Date of Patent: Nov. 21, 2006

(54) APPARATUS FOR VARIABLE DISPLACEMENT TYPE COMPRESSOR

(75) Inventors: Masakazu Murase, Kariya (JP); Masahiro Kawaguchi, Kariya (JP); Hiroaki Kayukawa, Kariya (JP); Satoshi Umemura, Kariya (JP)

(73) Assignee: Kabushiki Kaisha Toyota Jidoshokki, Kariya (JP)

( * ) Notice: Subject to any disclaimer, the term of this patent is extended or adjusted under 35 U.S.C. 154(b) by 0 days.

(21) Appl. No.: 10/845,816

(22) Filed: May 14, 2004

(65) Prior Publication Data

US 2004/0231348 A1 Nov. 25, 2004

(30) Foreign Application Priority Data

May 16, 2003 (JP) ..... 2003-139388

(51) Int. Cl.
*F25B 1/00* (2006.01)
*F25B 49/00* (2006.01)
*F04B 1/26* (2006.01)

(52) U.S. Cl. ..... 62/228.1; 62/229; 417/13; 417/14; 417/222.2; 184/6.17

(58) Field of Classification Search ..... 62/84, 62/192, 193, 228.1, 229, 468, 469; 417/13, 417/14, 222.2, 269, 270, 469; 184/6.17; 92/71

See application file for complete search history.

(56) References Cited

U.S. PATENT DOCUMENTS

| | | | | |
|---|---|---|---|---|
| 4,894,999 | A | 1/1990 | Kaiju et al. | 62/158 |
| 5,823,294 | A | 10/1998 | Mizutani et al. | 184/6.3 |
| 6,010,314 | A * | 1/2000 | Kobayashi et al. | 417/222.2 |
| 6,015,269 | A * | 1/2000 | Ota et al. | 417/222.2 |
| 6,203,284 | B1 * | 3/2001 | Kawaguchi et al. | 417/222.2 |
| 6,206,648 | B1 | 3/2001 | Kimura et al. | 417/222.2 |
| 6,551,072 | B1 | 4/2003 | Ota et al. | 417/222.2 |
| 2004/0148947 | A1 * | 8/2004 | Ota et al. | 62/84 |

FOREIGN PATENT DOCUMENTS

| | | |
|---|---|---|
| EP | 1 074 800 A2 | 2/2001 |
| EP | 1 122 430 A2 | 8/2001 |
| JP | 63-129250 | 6/1988 |
| JP | 2000-002183 | 1/2000 |
| JP | 2001-027177 | 1/2001 |

* cited by examiner

*Primary Examiner*—Marc Norman
(74) *Attorney, Agent, or Firm*—Morgan & Finnegan, LLP

(57) ABSTRACT

An apparatus for controlling a variable displacement compressor has an information detector and a controller. The information detector detects information about the thermal load on the refrigeration circuit. The controller determines a target value that reflects the displacement of the compressor based on the information about the thermal load detected by the information detector, and outputs the target value as a command value. When determining that the compressor is in a heavy load state based on information about a load on the compressor, the controller changes the command value to a value that causes the displacement of the compressor to become smaller than a displacement that corresponds to the determined target value.

21 Claims, 4 Drawing Sheets

APPARATUS FOR VARIABLE DISPLACEMENT TYPE COMPRESSOR

BACKGROUND OF THE INVENTION

The present invention relates to an apparatus for controlling the opening of a control valve in a variable displacement type compressor included in a refrigeration circuit.

A variable displacement type compressor disclosed in Japanese Laid-Open Patent Publication No. 2000-2183, for instance, has a structure in which lubricating oil contained in refrigerant gas flowing in a discharge passage from a compression chamber to an external refrigerant circuit is separated. In other words, the compressor is equipped in the discharge passage with a separation chamber for separating lubricating oil contained in the refrigerant gas. A crank case accommodating a crank mechanism communicates with the separation chamber through an oil return passage.

On the oil return passage, there is provided a control valve which can vary the opening of the oil return passage with a control signal from outside. The refrigerant gas is supplied from the separation chamber to the crank case via the control valve. The control valve regulates the displacement of the compressor.

In the configuration using the control valve, the inlet control valve is closed when the displacement of the compressor is to be maximized. As a consequence, no lubricating oil is supplied from the separation chamber to the crank case through the oil return passage. Especially when the displacement of the compressor is at its maximum, the compressor is at a high temperature, resulting in increasing requirement for lubrication.

SUMMARY OF THE INVENTION

An object of the present invention is to provide an apparatus which makes possible satisfactory lubrication of a variable displacement type compressor.

In order to achieve the object stated above, an apparatus for controlling a variable displacement compressor is provided. The compressor forms a refrigeration circuit with an external refrigerant circuit. The compressor includes a rotary shaft, a piston, a crank chamber, a separation chamber, an oil return passage, and a control valve. The piston compresses refrigerant gas drawn into a compression chamber. The crank chamber accommodates a crank mechanism that converts rotation of the rotary shaft into reciprocation of the piston. The separation chamber is located on a discharge passage that extends from the compression chamber to the external refrigerant circuit. Lubricating oil in the refrigerant gas is separated in the separation chamber. The oil return passage connects the separation chamber with the crank chamber. The control valve is located on the oil return passage. The control valve varies the opening degree of the oil return passage based on an external command. The displacement of the compressor is varied by controlling the pressure of the crank chamber through controlling the opening degree of the oil return passage. The apparatus has an information detector and a controller. The information detector detects information about a thermal load on the refrigeration circuit. The controller determines a target value that reflects the displacement of the compressor based on the information about the thermal load detected by the information detector, and outputs the target value as a command value. When determining that the compressor is in a heavy load state based on information about a load on the compressor, the controller changes the command value to a value that causes the displacement of the compressor to become smaller than a displacement that corresponds to the determined target value.

The present invention also provides a method for controlling a variable displacement compressor is provided. The compressor forms a refrigeration circuit with an external refrigerant circuit. The compressor includes a rotary shaft, a piston, a crank chamber, a separation chamber, an oil return passage, and a control valve. The piston compresses refrigerant gas drawn into a compression chamber. The crank chamber accommodates a crank mechanism that converts rotation of the rotary shaft into reciprocation of the piston. The separation chamber is located on a discharge passage that extends from the compression chamber to the external refrigerant circuit. Lubricating oil in the refrigerant gas is separated in the separation chamber. The oil return passage connects the separation chamber with the crank chamber. The control valve is located on the oil return passage. The control valve varies the opening degree of the oil return passage based on an external command. The displacement of the compressor is varied by controlling the pressure of the crank chamber through controlling the opening degree of the oil return passage. The method includes detecting information about a thermal load on the refrigeration circuit; determining a target value that reflects the displacement of the compressor based on the detected information about the thermal load; outputting the target value as a command value; determining that the compressor is in a heavy load state based on information about a load on the compressor; and changing the command value to a value that causes the displacement of the compressor to become smaller than a displacement that corresponds to the determined target value.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

A first preferred embodiment of the present invention, which is for a controller for a variable displacement type compressor C, will be described with reference to FIG. 1 through FIG. 3.

(Variable Displacement Type Compressor)

Figure 1:
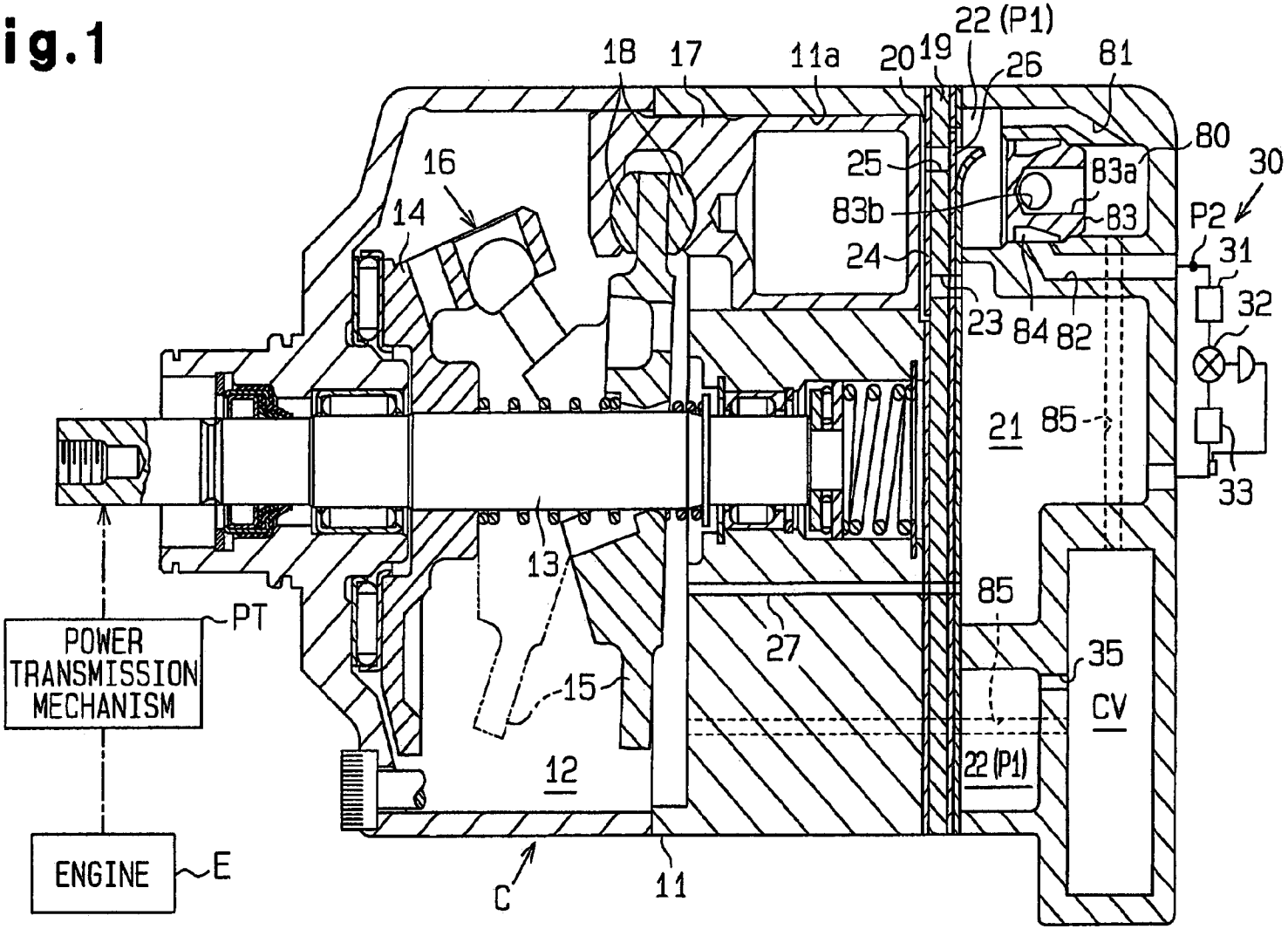
FIG. 1 shows a sectional view of a variable displacement type compressor in a first preferred embodiment of the invention.

As shown in FIG. 1, a crank case 12 is partitioned in a housing 11 of the variable displacement type compressor C. In the crank case 12 a rotation shaft 13 is rotatably supported. The front end of the rotation shaft 13 is operationally linked to an engine E, the drive power source for the vehicle, via a power transmission mechanism PT. (The left and right sides of FIG. 1 respectively correspond to the front and back).

The power transmission mechanism PT is a clutchless mechanism (e.g., involving a belt and pulleys) of a constant transmission type having no clutch mechanism. The power transmission mechanism PT may also be a clutch mechanism (e.g., an electromagnetic clutch) capable of choosing between power transmission and interception under electrical control from outside.

A swash plate 15 as a drive plate is housed in the crank case 12. The swash plate 15 is slidably and inclinably supported by the rotation shaft 13. A hinge mechanism 16 intervenes between a lag plate 14 and the swash plate 15. The swash plate 15 is operationally linked to the lag plate 14 and the rotation shaft 13 via the hinge mechanism 16. The swash plate 15 can rotate in synchronism with the lag plate 14 and the rotation shaft 13 and incline with respect to the rotation shaft 13.

In the housing 11 a plurality of cylinder bores 11*a* are formed (of which only one is shown in FIG. 1) at equal angular intervals around the rotation shaft 13. A single-headed piston 17 is reciprocatively accommodated in each of the cylinder bores 11*a*. In each of the cylinder bores 11*a* a compression chamber 20 whose volume varies with the reciprocation of the piston 17 is defined. Each of the pistons 17 is engaged with the outer circumference of the swash plate 15 via a shoe 18. The rotary motion of the swash plate 15 accompanying the rotation of the rotation shaft 13 is converted into the reciprocation of the pistons 17 via the shoes 18.

In the rear part of the housing 11 are partitioned an suction chamber 21 and a discharge chamber 22, with the discharge chamber 22 surrounding the suction chamber 21.

In a valve plate assembly 19, matching each of the cylinder bores 11*a*, a suction port 23 and a suction valve 24 are formed for opening and closing the suction port 23, a discharge port 25 and a discharge valve 26 for opening and closing the discharge port 25. The suction chamber 21 and each of the cylinder bores 11*a* communicate with each other via the suction port 23 matching the pertinent cylinder bore 11*a*. Each of the cylinder bores 11*a* communicates with the discharge chamber 22 via the discharge port 25 matching the pertinent cylinder bore 11*a*.

When each of the pistons 17 moves from the top dead center position to the bottom dead center position, refrigerant gas in the suction chamber 21 flows into the cylinder bore 11*a* via the suction port 23 and the suction valve 24. When a piston 17 moves from the bottom dead center position to the top dead center position, refrigerant gas in the cylinder bore 11*a*, after being compressed to a prescribed pressure, forces the discharge valve 26 to open via the discharge port 25 for discharging into the discharge chamber 22.

In this embodiment, the lag plate 14, the swash plate 15, the hinge mechanism 16 and the shoes 18 form the crank mechanism for converting the rotation of the rotation shaft 13 into the reciprocation of the pistons 17.

(Lubricating Oil Separating Structure)

In the housing 11 rearward the discharge chamber 22, a separation chamber 80 having a cylindrical inner circumferential face is formed and partitioned from the discharge chamber 22. The discharge chamber 22 communicates with the separation chamber 80 via an upstream communication passage 81.

A substantially cylindrical partitioning member 83 is located in the separation chamber 80. The partitioning member 83 divides between the separation chamber 80 and a downstream communication passage 82 connected to an external refrigerant circuit 30. An annular void portion 84 is formed on the outer circumferential side of the partitioning member 83. The downstream communication passage 82 communicates with the annular void portion 84. The separation chamber 80 communicates with the inner space 83*a* of the partitioning member 83. The inner space 83*a* of the partitioning member 83 communicates with the annular void portion 84 via a hole 83*b* bored in the circumferential wall of the partitioning member 83.

Refrigerant gas discharged from the compression chamber 20 to the discharge chamber 22 is introduced into the separation chamber 80 via the upstream communication passage 81 and guided in the separation chamber 80 to flow along its inner circumferential face. As a result, lubricating oil mist contained in the refrigerant gas is separated by centrifugal force. The refrigerant gas removed lubricating oil is discharged into the external refrigerant circuit 30 via the inner space 83*a*, the hole 83*b*, the annular void portion 84 and the downstream communication passage 82. The lubricating oil separated in the separation chamber 80 is supplied to the crank case 12 via an oil return passage 85 which establishes communication between the separation chamber 80 and the crank case 12.

The lubricating oil supplied to the crank case 12 is fed to sliding parts including, for instance, the linking parts between the pistons 17 and the shoes 18 and those between the shoes 18 and the swash plate 15 to lubricate and cool these parts. In this embodiment, the discharge chamber 22, the upstream communication passage 81, the separation chamber 80, the inner space 83*a*, the hole 83*b*, the annular void portion 84 and the downstream communication passage 82 form a discharge passage which provides a passage for refrigerant gas headed from the compression chamber 20 toward the external refrigerant circuit 30.

(Structure for Displacement Control of Compressor)

Within the housing 11 a bleed passage 27 which is involved in displacement control for the compressor C is provided. The bleed passage 27 establishes communication between the crank case 12 and the suction chamber 21. In this embodiment, the upstream communication passage 81, the separation chamber 80 and the oil return passage 85 are involved in the displacement control, and form a supply passage to establish communication between the discharge chamber 22 and the crank case 12. In the housing 11, a control valve CV is arranged over the oil return passage 85.

By adjusting the opening degree of the control valve CV, the balance between the volume of high pressure refrigerant gas let into the crank case 12 via the supply passage and that of gas let out of the crank case 12 via the bleed passage 27 is controlled to determine the pressure within the crank case 12. According to a change in the pressure within the crank case 12, the difference between the pressure within the crank case 12 (crank pressure) and the pressure within the compression chamber 20 via the pistons 17 is altered, and the angle of inclination of the swash plate 15 is changed. As a result, the stroke of the pistons 17 is altered to adjust the displacement of the compressor C.

For instance, when the opening degree of the control valve CV decreases, the crank pressure decreases. As a result, the difference between the crank pressure and the pressure within the cylinder bores 11*a* via the pistons 17 also becomes smaller. In turn, the angle of inclination of the swash plate 15 increases, and the displacement of the compressor C is increased. The decrease of the opening degree of the control valve CV causes the opening degree of the oil return passage 85 to decrease. Therefore, the volume of lubricating oil supplied from the separation chamber 80 to the crank case 12 via the oil return passage 85 decreases.

On the other hand, when the opening degree of the control-valve CV increases, the pressure-within the crank case 12 increases. As a result, the difference between the crank pressure and the pressure within the cylinder bores 11*a* via the pistons 17 increases. In turn, the angle of inclination of the swash plate 15 decreases, and the displacement of the compressor C decreases. When the opening degree of the control valve CV is increased, that of the oil return passage 85 also increases, and the volume of lubricating oil supplied from the separation chamber 80 to the crank case 12 via the oil return passage 85 increases.

(Refrigeration Circuit)

As shown in FIG. 1, the refrigeration circuit of an air conditioner for vehicle use includes the compressor C and the external refrigerant circuit 30. The external refrigerant circuit 30 includes a condenser 31, an expansion valve 32 and an evaporator 33.

Within the discharge chamber 22, a first pressure monitoring point P1 is set. Along the direction of the refrigerant passage away from the first pressure monitoring point P1 toward the condenser 31 (downstream) by a prescribed distance, a second pressure monitoring point P2 is set. The difference between a pressure PdH of the first pressure monitoring point P1 and a pressure PdL of the second pressure monitoring point P2 reflects the refrigerant flow rate of the refrigeration circuit. The first pressure monitoring point P1 communicates with the control valve CV via a first pressure detection passage 35. The second pressure monitoring point P2 communicates with the control valve CV via a second pressure detection passage 36 (see FIG. 2).

Figure 2:
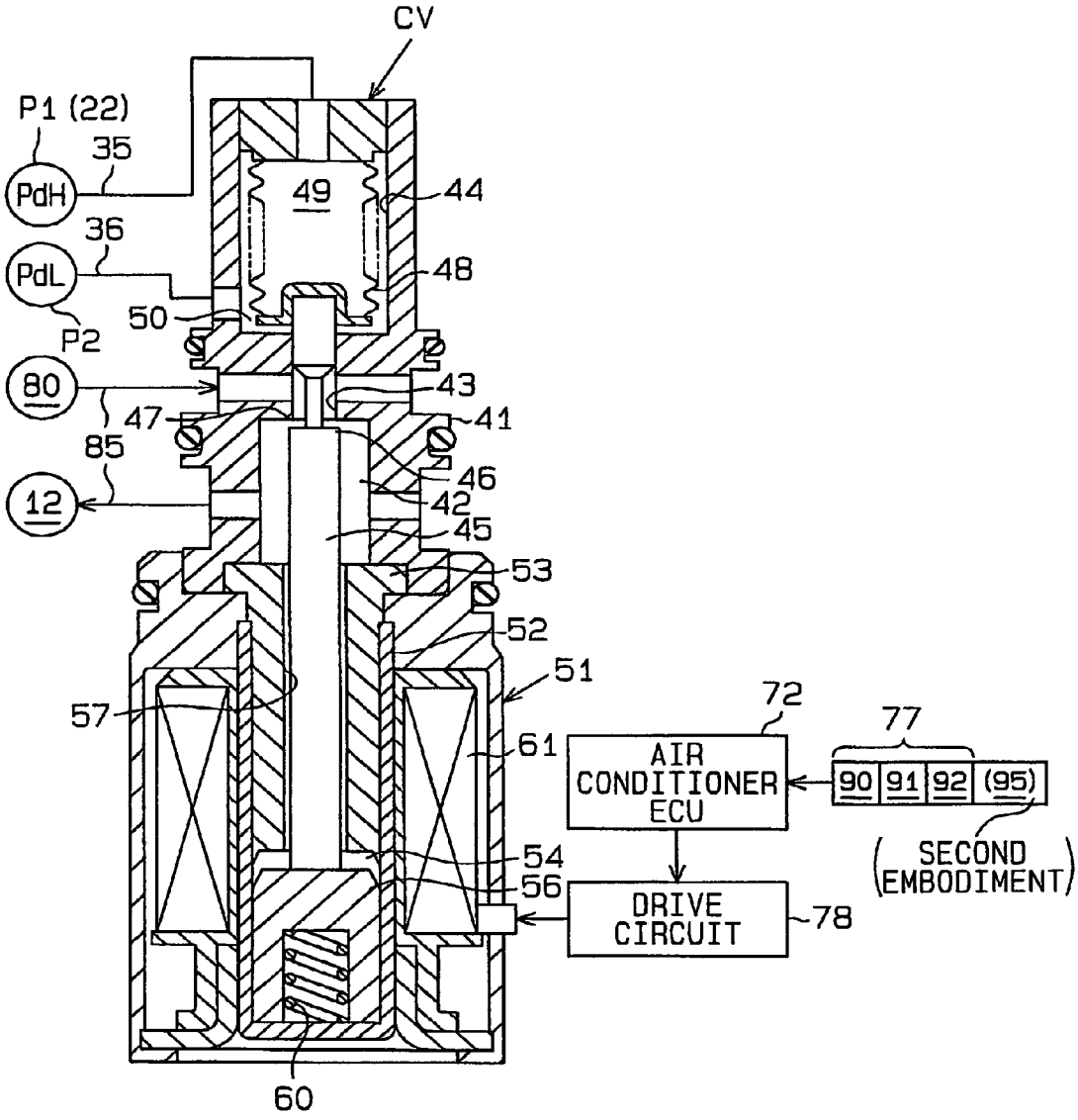
FIG. 2 shows a sectional view of a control valve provided in the compressor of FIG. 1.

As shown in FIG. 2, within a valve housing 41 of the control valve CV, a valve chest 42, a communication passage 43 and a pressure sensing chamber 44 are partitioned. Within the valve chest 42 and the communication passage 43 a rod 45 is arranged to be movable in the axial direction of the control valve CV (vertically in the drawing). The communication passage 43 and the pressure sensing chamber 44 are separated from each other by the upper end of the rod 45 being inserted into the communication passage 43. The valve chest 42 communicates with the separation chamber 80 via the upstream part of the oil return passage 85. The communication passage 43 communicates with the crank case 12 via the downstream part of the oil return passage 85. The valve chest 42 and the communication passage 43 form part of the oil return passage 85, i.e. part of the supply passage.

Within the valve chest 42, a valve body 46 formed in the intermediate part of the rod 45 is arranged. A level gap positioned on the boundary between the valve chest 42 and the communication passage 43 functions as a valve seat 47. When the rod 45 rises from the position in FIG. 2 (the lowest acting position) to the highest acting position where the valve body 46 of the rod 45 settles on the valve seat 47, the communication passage 43 is closed. The valve body 46 of the rod 45 functions as a valve body that can regulate the opening degree of the oil return passage 85, i.e. the supply passage.

Within the pressure sensing chamber 44, a pressure sensitive member 48 is accommodated, substantially cylindrically shaped and including a bellows. The upper end of the pressure sensitive member 48 is fixed to the valve housing 41. The upper end of the rod 45 is connected onto the lower end of the pressure sensitive member 48. The pressure sensitive member 48 partitions the inside of the pressure sensing chamber 44 into a first pressure chamber 49 and a second pressure chamber 50.

To the first pressure chamber 49, the pressure PdH of the first pressure monitoring point P1 is directed via the first pressure detection passage 35. To the second pressure chamber 50, the pressure PdL of the second pressure monitoring point P2 is directed via the second pressure detection passage 36.

The control valve CV is provided with a solenoid 51. The solenoid 51 functions as an electromagnetic actuator to control the rod 45. The solenoid 51 is provided with a bottomed cylindrical accommodating sleeve 52. A fixed iron core 53 is connected onto the accommodating sleeve 52. Within the accommodating sleeve 52 a plunger chamber 54 is partitioned.

Within the plunger chamber 54 a plunger (moving element) 56 is accommodated to be movable in the axial direction of the control valve CV. At the center of the fixed iron core 53 a guide hole 57 is formed extending in the axial direction. Within the guide hole 57 the base end of the rod 45 is arranged to be movable in the axial direction. The base end of the rod 45 is in contact with the plunger 56 within the plunger chamber 54.

Within the plunger chamber 54 a coil spring 60 is accommodated between the inner bottom face of the accommodating sleeve 52 and the plunger 56. The coil spring 60 presses the plunger 56 toward the rod 45. The rod 45 is pressed by the pressure sensitive member 48 toward the plunger 56. Therefore, the plunger 56 and the rod 45 move vertically, always integrated with each other. The pressing force of the pressure sensitive member 48 is greater than that of the coil spring 60.

Outside the fixed iron core 53 and the plunger 56 a coil 61 is wound. The coil 61 is supplied with an electric power from a drive circuit 78 on the basis of a command from an air conditioner ECU 72 matching external information from the external information detector 77. The coil 61 generates an electromagnetic force matching the electric power supplied to the coil 61 between the plunger 56 and the fixed iron core 53. The electromagnetic force is transmitted to the rod 45 via the plunger 56. Control of the electric power supplied to the coil 61 is accomplished by regulating the voltage applied. Regulation of the voltage applied is conducted by pulse width modulation (PWM) control.

(Operational Characteristics of Control Valve)

The arrangement of the rod 45 (the valve body 46), that is, the opening degree of the control valve CV is determined as follows.

First, when no electric power is supplied to the coil 61 (duty ratio Dt=0%) as shown in FIG. 2, the action of the downward force from the pressure sensitive member 48 becomes predominant in the disposition of the rod 45. Therefore, the rod 45 is disposed at the lowest acting position, and the valve body 46 fully opens the communication passage 43. As a result, the crank pressure becomes the possibly highest value in the situation in which the crank case 12 is then placed. Accordingly, the difference between the crank pressure and the pressure within the cylinder bores 11*a* increases. As a result, the angle of inclination of the swash plate 15 reaches its minimum, and so does the displacement of the compressor C.

Next, when the electric power of not less than the minimum duty ratio Dt(min) (>0%) in the variable range of the duty ratio is supplied to the coil 61, the upward electromagnetic force working on the coil spring 60 surpasses the downward pressing force of the pressure sensitive member 48, and the rod 45 moves upward. In this state, the upward electromagnetic force reinforced by the upward pressing force of the coil spring 60 holds out against the downward pressure based on the differential pressure ΔPd (=PdH−PdL) between two points and reinforced by the downward pressing force of the pressure sensitive member 48.

Where these upward and downward pressing forces are in equilibrium, the valve body 46 of the rod 45 is positioned relative to the valve seat 47, and the displacement of the compressor C is regulated.

Thus, the control valve CV positions the rod 45 by internal autonomous regulation according to variations in the differential pressure ΔPd between the two points so as to keep the differential pressure ΔPd at its target level determined by the duty ratio Dt of electric power supplied to the coil 61.

Further, where the power supply to the coil 61 is at its maximum (where the duty ratio Dt is at its maximum duty ratio Dt (max)), the action of the upward electromagnetic force of the coil 61 becomes predominant in the disposition of the rod 45. As a result, the valve body 46 totally closes the communication passage 43, and the displacement of the compressor C reaches its maximum.

(Air Conditioning Control)

As shown in FIG. 2, the external information detector 77 comprises an air conditioner switch 90, a temperature setter 91 and a temperature sensor 92. The air conditioner switch 90 is the main power switch for an air conditioner, and provides the air conditioner ECU 72 with information on whether the air conditioner is switched on or off. The temperature setter 91, with which the vehicle's occupant sets a desirable target temperature Te (set) in the passenger compartment, provides the air conditioner ECU 72 with information on the target temperature Te (set). The temperature sensor 92, arranged near the evaporator 33, provides the air conditioner ECU 72 with the detected temperature Te (t) as room temperature information.

The temperature setter 91 and the temperature sensor 92 respectively detect the target temperature Te (set) and the temperature Te (t) as information about the thermal load on the refrigeration circuit. The air conditioner ECU 72 as a controller, on the basis of detection information from the external information detector 77, regulates the duty ratio Dt of the control valve CV, in other words the target differential pressure of the control valve CV. Incidentally, the air conditioner ECU 72 and the external information detector 77 form an apparatus for controlling the compressor C.

Figure 3:
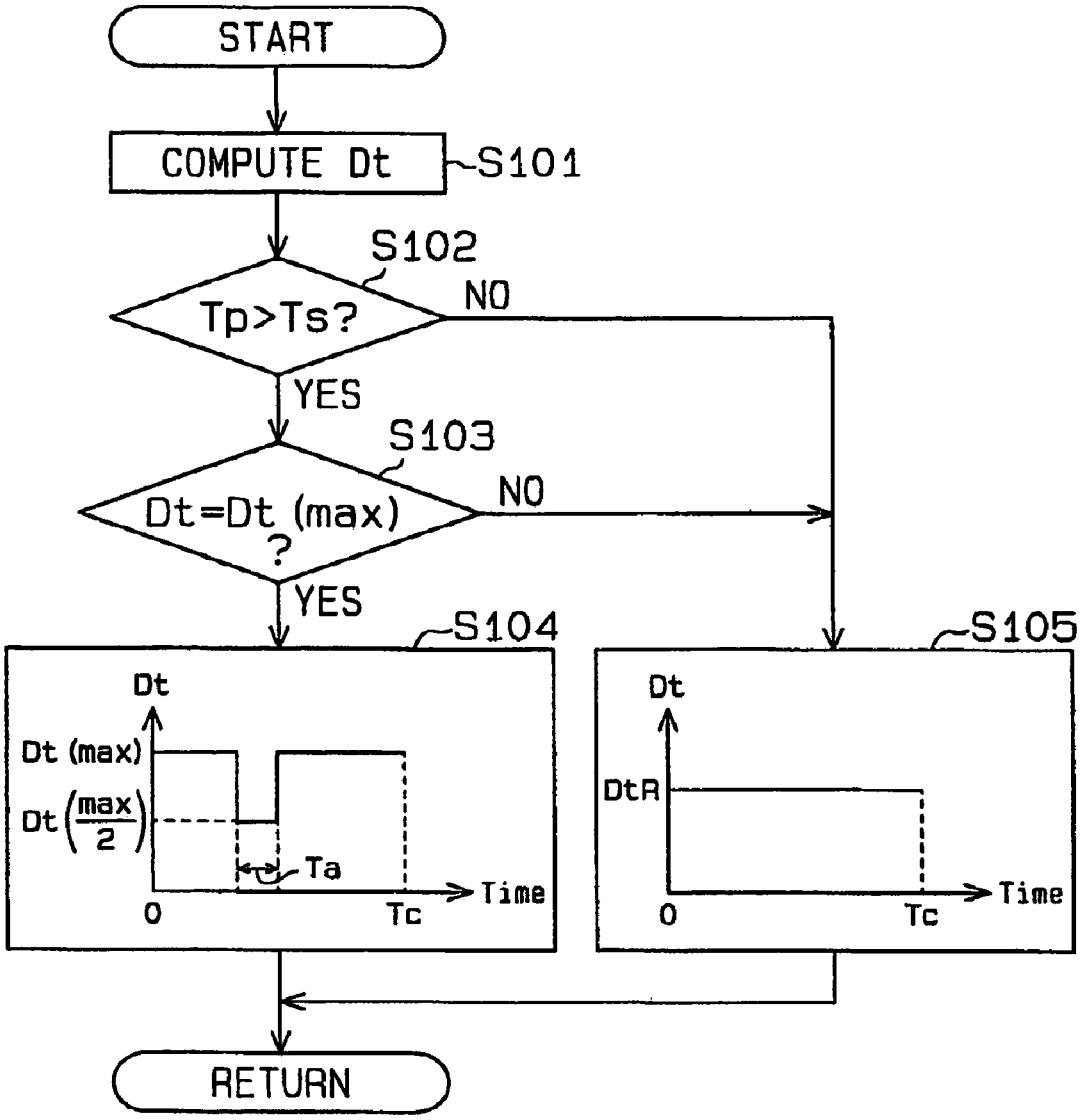
FIG. 3 is a flow chart of control of air conditioning in the first preferred embodiment of the invention.

The air conditioner ECU 72 performs processing shown in the flow chart of FIG. 3 on the basis of a preset program. When the air conditioner switch 90 is turned on, the air conditioner ECU 72 computes the duty ratio Dt at S101. In the processing of this computation, the target duty ratio Dt is computed from the refrigerant flow rate required by the refrigeration circuit computed on the basis of thermal load information from the external information detector 77.

At S102, the air conditioner ECU 72 determines whether or not the length of passed time Tp since the air conditioner switch 90 was turned on from an off state has surpassed a prescribed length of time Ts. If the determination is YES at S102, i.e., if a long enough time for lubricating oil to accumulate in a sufficient quantity in the separation chamber 80 has elapsed since the time the air conditioner switch 90 was turned on from the off state, the processing will proceed to S103. At S103, the air conditioner ECU 72 determines whether or not the duty ratio Dt computed at S101 is equal to the maximum duty ratio Dt (max) in the variable range of the duty ratio.

In this embodiment of the invention, the duty ratio Dt computed at S101 corresponds to information about the load on the compressor C. The maximum duty ratio Dt (max) is the upper limit value corresponding to a maximum displacement of the compressor C.

If the determination is YES at S103, the air conditioner ECU 72 determines a state in which the duty ratio Dt computed at S101 is closest to the maximum displacement of the compressor C, i.e., a heavy load state in which the oil return passage 85 is totally closed to allow no lubricating oil to be supplied from the separation chamber 80 to the crank case 12, and the processing shifts to S104.

At S104 command value changing control is performed by that the command value to the drive circuit 78 is changed, in a period Tc during which the duty ratio Dt computed at S101 is supplied to the drive circuit 78 as the command value, to a value that causes the displacement of the compressor to become smaller than a displacement that corresponds to the determined target value only during a prescribed first period Ta. Thus at S104, only during the first period Ta in the period Tc during which the maximum duty ratio Dt (max) is supplied as the command value, the command value to the drive circuit 78 is altered to a value smaller than the maximum duty ratio Dt (max). In this embodiment, the command value supplied only during the first period Ta is supposed to be an intermediate duty ratio Dt (max/2), equal to half the maximum duty ratio Dt (max).

In this way, even when the computed value is the maximum duty ratio Dt (max) in the state in which the oil return passage 85 is totally closed and no lubricating oil is supplied, the volume of lubricating oil supply can increase in the period Ta during which the value command to the drive circuit 78 is at the intermediate duty ratio Dt (max/2).

In this embodiment, the first period Ta during which the command value is changed to the intermediate duty ratio Dt (max/2) is set sufficiently short to affect by the smallest degree a change of the displacement of the compressor C in the control of the displacement using the target value (substantially zero). The first period Ta is determined by experiment or otherwise. In the displacement control, there is a certain limit to the response of the variation of the inclination angle of the swash plate 15 following the change of the opening of the control valve CV. For this reason, even if any variation arises in the command value to the drive circuit 78, the displacement control is not affected as long as the variation time is the short period, it does not affect the displacement control. The setting of the first period Ta makes use of this property.

On the other hand, if the judgment at either S102 or S103 is NO, the processing will shift to S105. At S105, the duty ratio Dt computed at S101 is supplied to the drive circuit 78 for the constant second period Tc as the command value DtR.

If the determination at S102, for instance, is NO, even if insufficient lubricating oil has accumulated in the separation chamber 80, the command value DtR will be supplied to the drive circuit 78 for the second period Tc. However, in this case, if the command value DtR is given the maximum duty ratio Dt (max), the oil return passage 85 will be totally closed and accordingly, even if insufficient lubricating oil has accumulated in the separation chamber 80, no refrigerant gas will leak from the separation chamber 80 to the crank case 12. In other words, there will be no adverse effect such as difficulty in maintaining the maximum displacement or a decrease in compression efficiency due to the aforementioned gas leak.

Conversely, if the command value DtR is given a value less than the maximum duty ratio Dt (max), the displacement control will conceivably demand an increase in the volume of refrigerant gas introduced from the separation chamber 80 to the crank case 12. As a consequence, even though lubricating oil has sufficiently accumulated in the separation chamber 80, the crank case 12 requires a further volume of refrigerant gas to be introduced from the separation chamber 80 to raise the crank pressure This is also true of a case in which the determination is NO at S103, for instance.

Upon completion of processing at S104 and S105, a shift to S101 follows.

This embodiment of the invention has the following advantages.

(1) When the duty ratio Dt computed on the basis of thermal load information from the external information detector 77 is equal to the maximum duty ratio Dt (max), in other words when the oil return passage 85 is totally closed, the command value to the drive circuit 78 is altered to the intermediate duty ratio Dt (max/2) only for the prescribed period Ta. As the change of the command value causes the opening degree of the oil return passage 85 to be increased only for the first period Ta in the second period Tc during which the command value is supplied to the drive circuit 78, the volume of lubricating oil supplied can be increased correspondingly. Therefore, the duty ratio Dt is maximized (the compressor C is placed under a heavy load), and satisfactory lubrication can be achieved in a situation where more lubrication for sliding parts is required.

(2) The change of the command value is supposed to be only temporary for part of the second period Tc. Therefore, the risk of any excessive change in displacement due to the change can be minimized as much as possible.

(3) When the air conditioner ECU 72 determines whether or not sufficient lubricating oil has accumulated in the separation chamber 80 and finds that sufficient lubricating oil has accumulated, permits the change of the command value from the maximum duty ratio Dt (max) to the intermediate duty ratio Dt (max/2).

Immediately after the actuation of the compressor C (switching on the air conditioner switch 90 from an off state) for instance, the discharge of refrigerant gas has just begun and lubricating oil may not have sufficiently accumulated in the separation chamber 80. In this state the air conditioner ECU 72 alters the command value, an excessive volume of refrigerant gas from the separation chamber 80 may be introduced into the crank case 12 via the oil return passage 85.

In this case, the introduction of refrigerant gas into the crank case 12 will excessively increase the pressure in the crank case 12. As a consequence, for instance, it may become difficult to maintain the displacement at its maximum or an excessive volume of refrigerant gas, which should be guided out to the external refrigerant circuit 30, may leak into the crank case 12. As a result, the compression efficiency of the compressor C is decreaed.

In this embodiment of the invention, as the air conditioner ECU 72 determines whether or not a sufficient volume of lubricating oil has accumulated in the separation chamber 80 and if the air conditioner ECU 72 determines that the sufficient volume of lubricating oil has accumulated, the air conditioner ECU 72 will permit changing of the command value, and lubricating oil can be supplied while preventing an excessive volume of refrigerant gas from being introduced from the separation chamber 80 to the crank case 12. Accordingly the problem noted above can be eliminated. Thus, it is made possible to maintain the displacement at its maximum and to prevent the compression efficiency of the compressor C from decreasing.

(4) The first period Ta during which the air conditioner ECU 72 changes the command value to the intermediate duty ratio Dt (max/2) is set sufficiently short to affect by the smallest degree (substantially zero) a change of the displacement of the compressor in the control of the displacement using the target value. For this reason, any excessive change of the displacement due to a change of the command value is avoided, resulting in stable displacement control.

Next will be described the second preferred embodiment of the present invention mainly with reference to FIG. 4 while referring to FIG. 1 through FIG. 3 as necessary. In the following paragraphs, only differences from the embodiment illustrated in FIG. 1 through FIG. 3 will be described, and the same reference numerals will be assigned to the same or equivalent members, with their description dispensed with.

In the embodiment illustrated in FIG. 1 through FIG. 3, the command value is changed when the duty ratio Dt computed by the air conditioner. ECU 72 is equal to the maximum duty ratio Dt (max). In this embodiment, the command value is altered when the heat emission by the compressor C is judged to be higher than a prescribed level on the basis of information on heat emission by the compressor C.

In this embodiment of the invention, as shown in FIG. 2, the air conditioner ECU 72 is provided with information from a housing temperature sensor 95 in addition to information from the aforementioned external information detector 77. The housing temperature sensor 95, arranged in the housing 11 of the compressor C, measures the temperature of the housing 11 and provides the detected temperature H(t) to the air conditioner ECU 72 as information on heat emission by the compressor C (load information on this embodiment).

Figure 4:
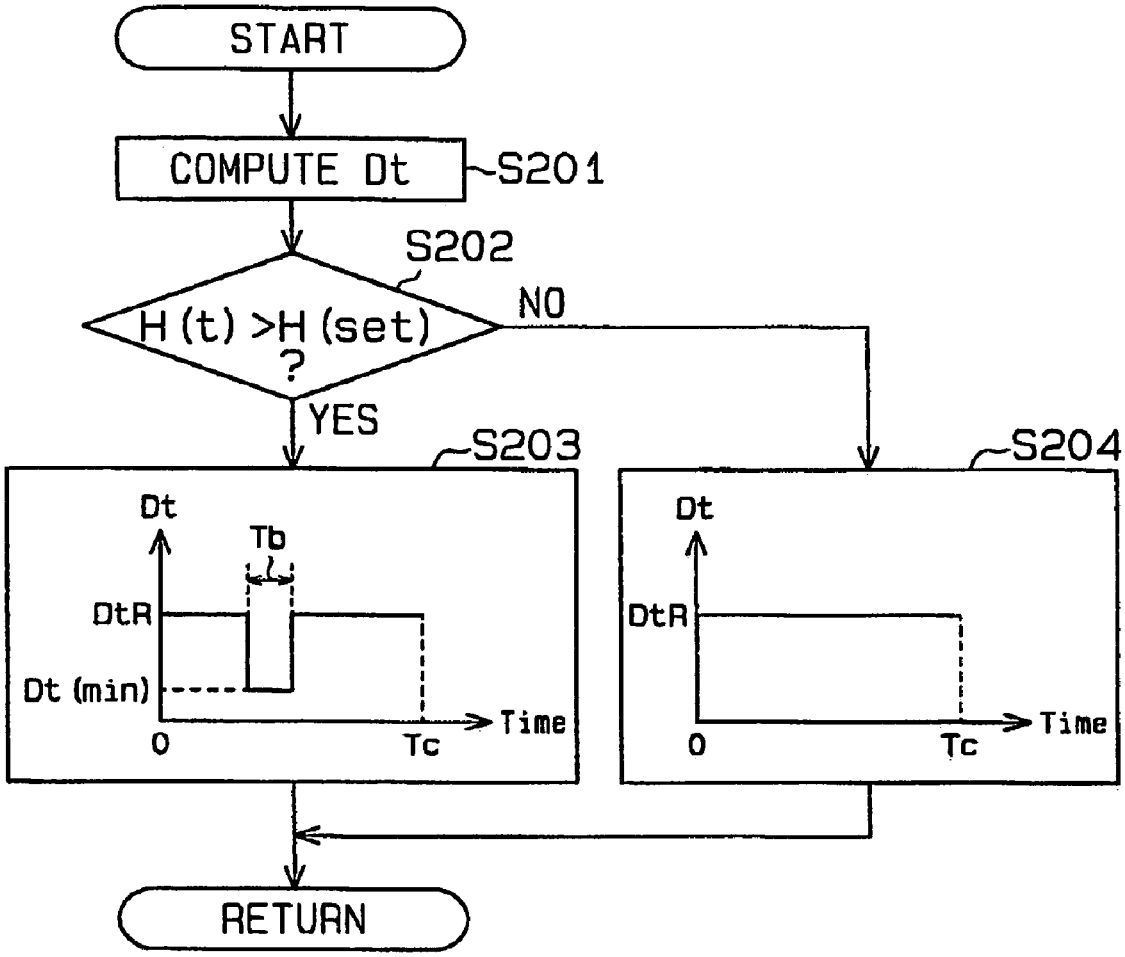
FIG. 4 is a flow chart of control of air conditioning in a second preferred embodiment of the invention

The air conditioner ECU 72 performs processing shown in the flow chart of FIG. 4 on the basis of a preset program. The air conditioner ECU 72, when the air conditioner switch 90 is turned on, processes at S201 a similar computation of the duty ratio Dt to that at S101 in the first embodiment.

At S202, on the basis of information from the housing temperature sensor 95, the air conditioner ECU 72 judges whether or not the temperature H(t) of the housing 11 is higher than a preset prescribed temperature H(set). If the judgment is YES at S202, i.e., if the heat emitted by the compressor C is higher than the prescribed level, meaning a heavy load state and accordingly a high level of lubrication demand, the processing will proceed to S203.

At S203, during the second period Tc in which the duty ratio Dt computed at S201 is supplied to the drive circuit 78 as the command value, command value altering control is processed by that the command value to the drive circuit 78 is altered to a smaller displacement than the computed value only during a third period Tb. Thus, if the temperature H(t) of the housing 11 is higher than the preset prescribed temperature H(set), the command value to the drive circuit 78 is altered to a smaller value than the command value DtR only during the prescribed period Tb in the period Tc during which the duty ratio Dt computed at S201 is supplied as the command value DtR. In this embodiment, the command value supplied only during the third period Tb is set to the minimum duty ratio Dt (min) at the lower; limit of the variable range of the duty ratio.

In this way, when the heat emitted by the compressor C is above the prescribed level and accordingly the requirement for lubrication is considered higher, the volume of lubricating oil supply can be increased.

In this embodiment, the third period Tb in which the command value is changed to the minimum duty ratio Dt (min) is set sufficiently short to affect by the smallest degree (substantially zero) a change of the displacement of the compressor C in the control of the displacement using the target value.

On the other hand, if the determination is NO at S202, the processing will shift to S204. At S204, the duty ratio Dt computed at S201 is supplied to the drive circuit 78 as the command value DtR during the second period Tc.

Upon completion of processing at S203 and S204, a shift to S201 follows.

This embodiment of the invention has the following advantages in addition to those stated in (2) and (4) above.

(5) If it is determined on the basis of heat emission information from the housing temperature sensor 95 that heat emitted by the compressor C is higher than the prescribed level, the command value to the drive circuit 78 is altered to the minimum duty ratio Dt (min) only during the third period Tb. As this change of the command value causes the opening of the oil return passage 85 to be widened to its maximum only during the third period Tb in the second period TC during which the command value is supplied to the drive circuit 78, the volume of lubricating oil supply can be increased correspondingly. Therefore, satisfactory lubrication can be achieved in a situation where the lubrication requirement for the compressor C tends to increase.

It should be apparent to those skilled in the art that the present invention may be embodied in many other specific forms without departing from the spirit or scope of the invention. Particularly, it should be understood that the invention may be embodied in the following forms.

In the embodiment shown in FIG. 1 through FIG. 3, if for instance the power transmission mechanism PT operationally linking the engine E and the compressor C has an electromagnetic clutch mechanism which can turn on and off the transmission of power between the Engine E and the compressor C at a command from outside, it is also acceptable to determine whether or not a prescribed length of time has passed since the point of time at which this electromagnetic clutch mechanism was changed over from a state in which power transmission is cut off to a state in which the power transmission is connected.

In the embodiment shown in FIG. 1 through FIG. 3, the air conditioner ECU 72 may as well be provided anew, for instance, with a sensor capable of detecting the volume of lubricating oil having accumulated in the separation chamber 80 so that it can be judged on the basis of detection information from this sensor whether or not lubricating oil has sufficiently accumulated in the separation chamber 80, In the embodiment shown in FIG. 1 through FIG. 3, the step of determining whether or not lubricating oil has sufficiently accumulated in the separation chamber 80 (step S102) can be dispensed with.

In the embodiment shown in FIG. 1 through FIG. 3, the command value to the drive circuit 78 need not be equal to half of the maximum duty ratio Dt (max) if only the command value is to reduce the displacement to a level below that corresponding to the maximum duty ratio Dt (max) (the computed value at S101).

In the embodiment shown in FIG. 1 through FIG. 3, the upper limit of the displacement in the signal supplied from the air conditioner ECU 72 to the drive circuit 78 may as well be a variable value whose range (width) has as a lower limit that is a lower value than the maximum duty ratio Dt (max) and has as an upper limit of the maximum duty ratio Dt (max).

In the flow chart of FIG. 4, there may be added a step of determining whether or not sufficient lubricating oil has accumulated in the separation chamber 80 (a step similar to S102 in FIG. 3). In this case, if the judgment at this step is YES, processing to S203 is permitted.

In the embodiment according to the flow chart in FIG. 4, for instance the temperature of the crank case 12 or that of the discharged refrigerant gas may as well be used as heat emission information for the criterion of the aforementioned determination.

In place of the heat emission information in the embodiment according to the flow chart in FIG. 4, the pressure of the discharged refrigerant gas or the rotation speed of the rotation shaft 13 may as well be used as information about the load on the compressor C.

In the embodiment according to the flow chart in FIG. 4, the command value to the drive circuit 78 need not be the minimum duty ratio Dt (min) if the command value is only to reduce the displacement to a level below that corresponding to the value computed at S201.

In the embodiments shown in FIG. 1 through FIG. 4, while the first and third periods Ta and Tb during which the command value to the drive circuit 78 is changed are set sufficiently short to affect by the smallest degree (substantially zero) a change of the displacement of the compressor C in the control of the displacement-using the target value, this is not an absolute limitation, and any appropriate change would be acceptable.

In the embodiment shown in FIG. 1 through FIG. 3, the processing may as well be such that the command value to the drive circuit 78 is changed to a value to reduce the displacement over the second period Tc equivalent to the one routine cycle to be executed next when an affirmative determination at S103 is repeated a prescribed number of times. In this case, if the number of times of the affirmative determination is made at S103 does not reach a prescribed value, the maximum duty ratio Dt (max) will be supplied continually.

In the embodiment according to the flow chart in FIG. 4, the processing may as well be such that the command value to the drive circuit 78 is changed to a value to reduce the displacement over the second period Tc equivalent to the one routine cycle to be executed next when an affirmative determination at S202 is repeated a prescribed number of times. In this case, if the number of times of the affirmative determination is made at S202 does not reach a prescribed value, the command value DtR will be supplied continually.

In these cases, "the period during which the target value is supplied by the air conditioner ECU 72" is equal to a plurality of times as long as the second period Tc.

In the embodiment according to the flow chart in FIG. 4, the processing may as well be such that the command value altered to a value to make the displacement smaller than the value computed at S201 continues to be supplied to the drive circuit 78, if the determination at S202 is YES, until the determination at S202 becomes NO.

The air conditioner ECU 72 may as well be caused to carry out in parallel the process shown in the flow chart of FIG. 3 and the process shown in the flow chart of FIG. 4.

The present invention may also be applied to a controller for a compressor equipped with a control valve whose opening widens with an increase in the duty ratio Dt.

The present examples and embodiments are to be considered as illustrative and not restrictive and the invention is not to be limited to the details given herein, but may be modified within the scope and equivalence of the appended claims.

What is claimed is:

1. An apparatus for controlling a variable displacement compressor that forms a refrigeration circuit with an external refrigerant circuit, the compressor including a rotary shaft, a piston for compressing refrigerant gas drawn into a compression chamber, a crank chamber for accommodating a crank mechanism that converts rotation of the rotary shaft into reciprocation of the piston, a separation chamber located on a discharge passage that extends from the compression chamber to the external refrigerant circuit, wherein lubricating oil in the refrigerant gas is separated in the separation chamber, an oil return passage for connecting the separation chamber with the crank chamber, and a control valve located on the oil return passage, wherein the control valve varies the opening degree of the oil return passage based on an external command, and wherein the displacement of the compressor is varied by controlling the pressure of the crank chamber through controlling the opening degree of the oil return passage, the apparatus comprising:

an information detector for detecting information about a thermal load on the refrigeration circuit; and a controller, wherein the controller determines a target value that reflects the displacement of the compressor based on the information about the thermal load detected by the information detector, and outputs the target value as a command value, and wherein, when determining that the compressor is in a heavy load state based on information about a load on the compressor, the controller changes the command value to a value that causes the displacement of the compressor to become smaller than a displacement that corresponds to the determined target value.

2. The apparatus according to claim 1, wherein the compressor has a maximum displacement and when the determined target value is an upper limit value that corresponds to the maximum displacement of the compressor, the controller determines that the compressor is in a heavy load state.

3. The apparatus according to claim 1, wherein the compressor has a maximum displacement and when the determined target value is an upper limit value that corresponds to the maximum displacement of the compressor, the controller temporarily changes the command value to a value that causes the displacement of the compressor to become smaller than a displacement that corresponds to the determined target value.

4. The apparatus according to claim 3, wherein the period during which the command value is changed is set sufficiently short to affect by the smallest degree a change of the displacement of the compressor in the control of the displacement using the target value.

5. The apparatus according to claim 1, wherein the information about the load of the compressor includes heat emission of the compressor, and when determining that the heat emission of the compressor is greater than a predetermined value, the controller changes the command value to a value that causes the displacement of the compressor to become smaller than a displacement that corresponds to the determined target value.

6. The apparatus according to claim 5, wherein the command value is temporarily changed within a predetermined period during which the target value is outputted.

7. The apparatus according to claim 5, wherein the period during which the command value is changed is set sufficiently short to affect by the smallest degree a change of the displacement of the compressor in the control of the displacement using the target value.

8. The apparatus according to claim 1, wherein the controller permits the command value to be changed when lubricant oil accumulates in the separation chamber.

9. The apparatus according to claim 8, wherein the information detector includes a switch for actuating the compressor, and the controller determines whether lubricating oil accumulates in the separation chamber based on elapsed time from when the switch is turned on.

10. The apparatus according to claim 1, wherein, when a rotation speed of the rotary shaft is greater than a predetermined value, the controller changes the command value to a value that causes the displacement of the compressor to become smaller than a displacement that corresponds to the determined target value.

11. A method for controlling a variable displacement compressor that forms a refrigeration circuit with an external refrigerant circuit, the compressor including a rotary shaft, a piston for compressing refrigerant gas drawn into a compression chamber, a crank chamber for accommodating a crank mechanism that converts rotation of the rotary shaft into reciprocation of the piston, a separation chamber located on a discharge passage that extends from the compression chamber to the external refrigerant circuit, wherein lubricating oil in the refrigerant gas is separated in the separation chamber, an oil return passage for connecting the separation chamber with the crank chamber, and a control valve located on the oil return passage, wherein the control valve varies the opening degree of the oil return passage based on an external command, and wherein the displacement of the compressor is varied by controlling the pressure of the crank chamber through controlling the opening degree of the oil return passage, the method including:

detecting information about a thermal load on the refrigeration circuit;

determining a target value that reflects the displacement of the compressor based on the detected information about the thermal load;

outputting the target value as a command value;

determining that the compressor is in a heavy load state based on information about a load on the compressor; and changing the command value to a value that causes the displacement of the compressor to become smaller than a displacement that corresponds to the determined target value.

12. The method according to claim 11, wherein the compressor has a maximum displacement, wherein the compressor in a heavy load state corresponds to that the determined target value is an upper limit value that corresponds to the maximum displacement of the compressor.

13. The method according to claim 11, wherein the compressor has a maximum displacement, wherein, when the determined target value is an upper limit value that corresponds to the maximum displacement of the compressor, the command value is temporarily changed to a value that causes the displacement of the compressor to become smaller than a displacement that corresponds to the determined target value.

14. The method according to claim 13, wherein the period during which the command value is changed is set sufficiently short to affect by the smallest degree a change of the displacement of the compressor in the control of the displacement using the target value.

15. The method according to claim 11, wherein the information about the load of the compressor includes heat emission of the compressor, and when determining that the heat emission of the compressor is greater than a predetermined value, the command value is changed to a value that causes the displacement of the compressor to become smaller than a displacement that corresponds to the determined target value.

16. The method according to claim 15, wherein the command value is temporarily changed within a predetermined period during which the target value is outputted.

17. The method according to claim 15, wherein the period during which the command value is changed is set sufficiently short to affect by the smallest degree a change of the displacement of the compressor C in the control of the displacement using the target value.

18. The method according to claim 11, wherein the command value is permitted to be changed when lubricant oil accumulates in the separation chamber.

19. The method according to claim 18 includes determining whether lubricating oil accumulates in the separation chamber based on elapsed time from when a switch for actuating the compressor is turned on.

20. The method according to claim 11, wherein, when a rotation speed of the rotary shaft is greater than a predetermined value, the command value is changed to a value that causes the displacement of the compressor to become smaller than a displacement that corresponds to the determined target value.

21. An improved variable displacement compressor that forms a refrigeration circuit with an external refrigerant circuit, the compressor including a rotary shaft, a piston for compressing refrigerant gas drawn into a compression chamber, a crank chamber for accommodating a crank mechanism that converts rotation of the rotary shaft into reciprocation of the piston, a separation chamber located on a discharge passage that extends from the compression chamber to the external refrigerant circuit, wherein lubricating oil in the refrigerant gas is separated in the separation chamber, an oil return passage for connecting the separation chamber with the crank chamber, and a control valve located on the oil return passage, wherein the control valve varies the opening degree of the oil return passage based on an external command, and wherein the displacement of the compressor is varied by controlling the pressure of the crank chamber through controlling the opening degree of the oil return passage, the improvement comprising:

an information detector for detecting information about a thermal load on the refrigeration circuit; and a controller, wherein the controller determines a target value that reflects the displacement of the compressor based on the information about the thermal load detected by the information detector, and outputs the target value as a command value, and wherein, when determining that the compressor is in a heavy load state based on information about a load on the compressor, the controller changes the command value to a value that causes the displacement of the compressor to become smaller than a displacement that corresponds to the determined target value.

* * * * *